US010471294B1

(12) United States Patent
Montano

(10) Patent No.: US 10,471,294 B1
(45) Date of Patent: Nov. 12, 2019

(54) PORTABLE EXERCISE DEVICE

(71) Applicant: Marco Montano, Forest Hills, NY (US)

(72) Inventor: Marco Montano, Forest Hills, NY (US)

( * ) Notice: Subject to any disclaimer, the term of this patent is extended or adjusted under 35 U.S.C. 154(b) by 112 days.

(21) Appl. No.: 15/725,982

(22) Filed: Oct. 5, 2017

(51) Int. Cl.
*A63B 21/16* (2006.01)
*A63B 21/00* (2006.01)
*A63B 23/035* (2006.01)

(52) U.S. Cl.
CPC .... *A63B 21/1663* (2013.01); *A63B 21/00047* (2013.01); *A63B 21/4035* (2015.10); *A63B 21/4043* (2015.10); *A63B 23/03525* (2013.01); *A63B 2208/0204* (2013.01)

(58) Field of Classification Search
CPC ..... A63B 21/1618; A63B 21/1654; A63B 21/1663; A63B 21/169; A63B 21/4043; A63B 21/4035; A63B 21/00047; A63B 23/03525; A63B 2208/0204
See application file for complete search history.

(56) References Cited

U.S. PATENT DOCUMENTS 5,302,164 A * 4/1994 Austin ..... A63B 21/0023 482/39
5,871,422 A 2/1999 Elbogen
6,030,324 A * 2/2000 McBride ..... A63B 21/072 482/142
6,248,048 B1 6/2001 Zuckerman et al.
7,217,227 B2 5/2007 Finn
9,114,273 B2 8/2015 Kehoe et al.
9,138,609 B2 9/2015 Placide
9,327,153 B2 5/2016 Wallisch
9,452,308 B2 9/2016 Lentz et al.
2001/0004624 A1* 6/2001 Cournoyer ..... A63B 21/068 482/141
2013/0217544 A1* 8/2013 Anaya ..... A63B 21/1627 482/40
2013/0225373 A1 8/2013 Poat
2014/0323275 A1* 10/2014 Moses, II ..... A63B 21/1627 482/40
2017/0274245 A1* 9/2017 Cambridge, Sr. .. A63B 23/1227

* cited by examiner

*Primary Examiner* — Loan B Jimenez
*Assistant Examiner* — Kathleen Vermillera
(74) *Attorney, Agent, or Firm* — Goldstein Law Offices, P.C.

(57) ABSTRACT

A portable exercise device positioned laterally across a doorway with first and second vertical sides and a threshold, providing a stable platform for a user to perform upper and lower body exercises, wherein the device includes a horizontal exercise bar configured with hand grips, supported by a vertical supporting member. A vertical extension assembly allows the horizontal exercise bar to be raised and lowered. The vertical supporting member incorporates a vertical support plate which abuts against the first vertical side of the doorway, and an anchoring assembly which engages an anchoring point where the second vertical side meets the threshold. The user grasps the hand grips to perform exercises such as dips and leg lifts, while the vertical supporting member exerts force against the doorway via the vertical support plate and the anchoring assembly simultaneously, securely retaining the portable exercise device between the first and second vertical sides.

7 Claims, 9 Drawing Sheets

PORTABLE EXERCISE DEVICE

TECHNICAL FIELD

The present disclosure relates generally to an exercise device. More particularly, the present disclosure relates to a portable exercise device configured to be securely retained within a doorway, which allows a user to perform upper body and lower body exercises.

BACKGROUND

A complete exercise routine incorporates both upper body and lower body exercises, and dip machines allow users to perform both types without relying on complex mechanisms or weights. Dip exercises performed on a dip machine are an excellent way to strengthen the muscles of the upper body, by working not only the triceps, but the muscles of the forearms, shoulders, chest, and lower back as well. Dip machines also allow users to perform hanging leg lifts which strengthen the muscles of the entire abdominal area.

There are many types of dip machines available for both home and gym use, which generally provide a pair of bars or hand grips which allow users to perform dips and other exercises in a suspended or hanging position. Many dip machines require large stabilizing measures, such as legs, bars, bases, and other structures for supporting the weight of dip machine users and ensuring that the dip machines remain upright, often rendering these devices unsuitable for residential use when space within the home is scarce.

Some examples of exercise devices found in the prior art seek to address the problem of space through devices which rely on door frames to support the weight of the user. Certain prior art exercise devices are designed to be suspended from the top of door frames, but have the disadvantage of causing injury if parts of the door frame should fail under stress while the user is performing a workout. Furthermore, these devices cannot be used in doorways which lack the required frame elements. Other exercise devices designed to operate within doorways are often complex, bulky, and cumbersome, negating the space saving advantage which door frame devices have over free-standing dip machines.

Therefore, there is a need for an exercise device that is compact as well as stable, which addresses the disadvantages of both the free-standing and door frame devices found in the prior art.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide a portable exercise device which allows a user to perform upper body and lower body exercises. The portable exercise device is further configured to be retained within a doorway having a first vertical side, a second vertical side, a threshold, and an anchoring point defined by the junction between the second vertical side and the threshold. Accordingly, the present disclosure provides a portable exercise device comprising a horizontal exercise bar and a vertical supporting member configured to support the horizontal exercise bar. The vertical supporting member further has a vertical support plate configured to abut against the first vertical side, and an anchoring bar configured to engage with the anchoring point, allowing the portable exercise device to be securely retained in the doorway between the first vertical side and the second vertical side.

It is another aspect of an example embodiment in the present disclosure to provide a portable exercise device which allows the user to perform dip exercises and leg lift exercises. Accordingly, the horizontal exercise bar comprises a first exercise arm and a second exercise arm arranged in a substantially parallel configuration, with first and second hand grips disposed on the first and second exercise arms respectively. In order to perform a dip exercise, the user stands between the first and second exercise arms while grasping the first and second hand grips. The user then pushes against the first and second hand grips while straightening his or her arms such that the user is suspended between the first and second exercise arms. The user may then perform dips by repeatedly bending and straightening his or her arms. The user may perform leg lifts by grasping the first and second hand grips in the manner above while facing the second vertical side, and repeatedly raising and lowering his or her legs.

It is a further aspect of an example embodiment in the present disclosure to provide a portable exercise device with a horizontal exercise bar that can be raised or lowered to accommodate the height of the user and the height of the doorway. Accordingly, the horizontal exercise bar is connected to the vertical supporting member through a vertical extension assembly comprising a vertical extension member and a vertical extension sleeve, and the vertical extension member is configured to extend and retract within the vertical extension sleeve, allowing the horizontal exercise bar to be raised and lowered. The vertical extension assembly may further comprise a vertical extension locking mechanism capable of locking the vertical extension member in a fully retracted position, a fully extended position, or one or more incremental extension positions in between the fully retracted and fully extended positions.

It is yet another aspect of an example embodiment in the present disclosure to provide further elements adapted to securely retain the portable exercise device within the doorway. Accordingly, the vertical support plate may be configured with a friction layer formed of high-friction material which allows the vertical support plate to grip the first vertical side and prevent lateral movement between the vertical support plate and the first vertical side. The anchoring assembly can further comprise an anchoring bar configured with a first friction sleeve and a second friction sleeve formed of high-friction material which allows the anchoring assembly to grip the anchoring point and prevent lateral movement between the anchoring assembly and the anchoring point.

It is yet a further aspect of an example embodiment in the present disclosure to provide an anchoring assembly capable of engaging with the anchoring point in a doorway where the second vertical side has a door stop. Accordingly, the anchoring assembly may further comprise a retaining gap defined by the space between the first friction sleeve and the second friction sleeve which is further configured so that the door stop fits within the retaining gap, allowing the first and second friction sleeves to engage with the anchoring point.

It is still a further aspect of an example embodiment in the present disclosure to provide a portable exercise device supported by a unitary vertical supporting member. Accordingly, the vertical supporting member may be formed as a vertically oriented tube further incorporating a vertical supporting member bend, and a vertical supporting member arc.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Figure 1:
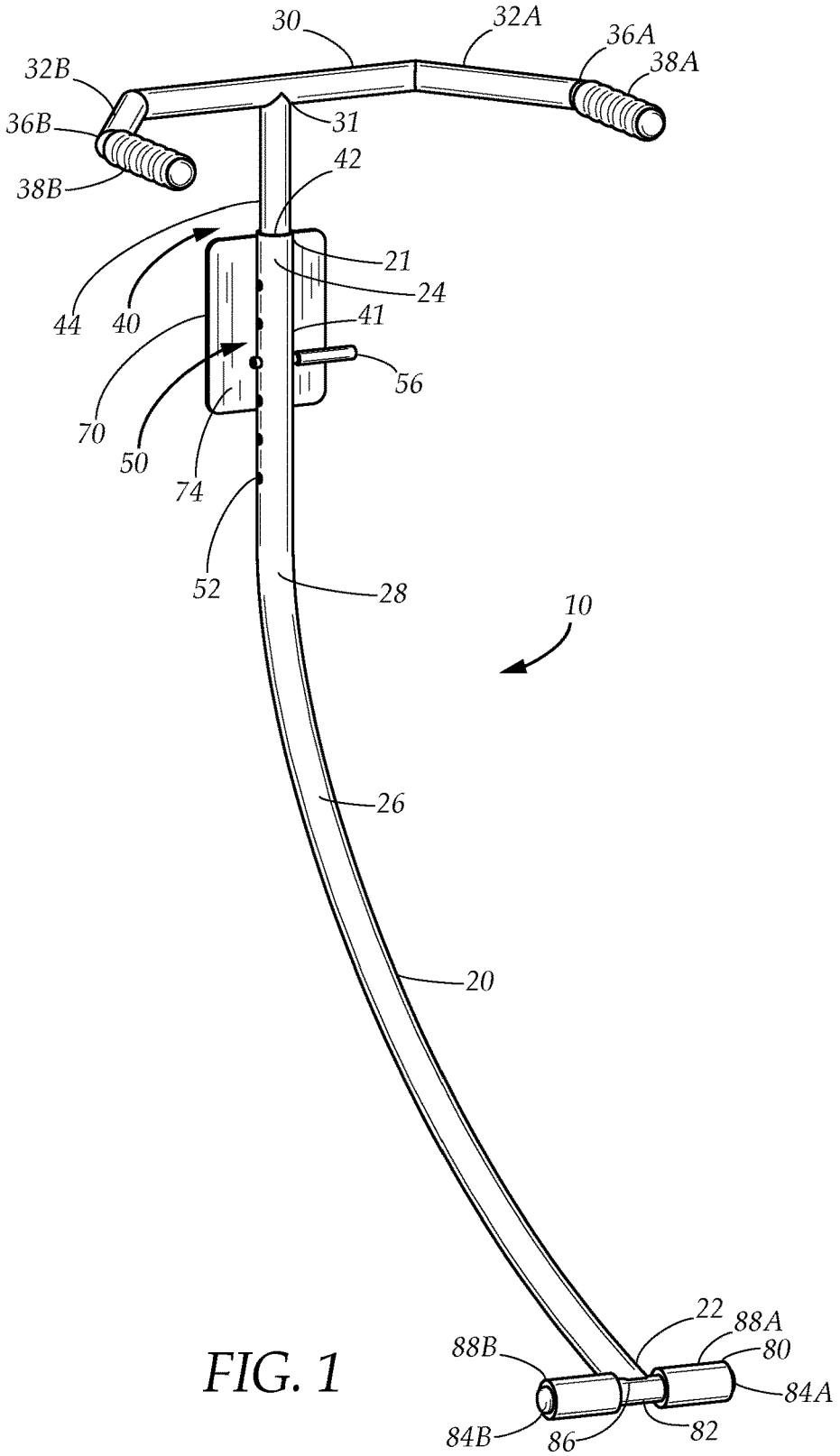
FIG. 1 is a diagrammatic perspective view showing an embodiment of a portable exercise device having a horizontal exercise bar connected to a vertical supporting member, in accordance with the present disclosure.

FIG. 1 illustrates an exemplary embodiment of a portable exercise device 10 comprising a horizontal exercise bar 30 connected to a vertical supporting member 20. The horizontal exercise bar 30 is configured with a first handgrip 38A and a second handgrip 38B, allowing a user to perform upper body exercises and lower body exercises such as dips and leg lifts while gripping the first and second handgrips 38A, 38B. The portable exercise device 10 can be configured with a vertical extension assembly 40 which connects the horizontal exercise bar 30 to the vertical supporting member 20, allowing the horizontal exercise bar 30 to be raised and lowered so that the portable exercise device 10 can be adapted to the height of the user, or to adjust the amount of clearance between the user's legs and the ground to aid in the performance of the exercises. The portable exercise device 10 is configured to be positioned laterally within a doorway having a first vertical side, a second vertical side opposite to the first vertical side, and a threshold. The portable exercise device 10 further comprises a vertical support plate 70 configured to contact the first vertical side and an anchoring assembly 80 configured to simultaneously contact the second vertical side and the threshold. The vertical support plate 70 and the anchoring assembly 80 exert force in different directions against the doorway, allowing the portable exercise device 10 to be securely retained within the doorway.

The horizontal exercise bar 30 comprises a first exercise arm 36A, a second exercise arm 36B, and a horizontal exercise bar central point 31 located at the midpoint between the first and second exercise arms 36A, 36B. The first handgrip 38A is disposed on the first exercise arm 36A, and the second handgrip 38B is disposed on the second exercise arm 36B. The horizontal exercise bar 30 may further comprise a first bend 32A located between the first exercise arm 36A and the horizontal exercise bar central point 31, and a second bend 32B located between the second exercise arm 36B and the horizontal exercise bar central point 31. The horizontal exercise bar 30 can be configured such that the first exercise arm 36A extends away from the first bend 32A and the second exercise arm 36B extends away from the second end 32B such that the first exercise arm 36A is substantially parallel to the second exercise arm 36B. The horizontal exercise bar 30 can be formed from steel, aluminum, titanium, or other suitable material. In other embodiments, the first and second exercise arms 36A, 36B can be arranged in other configurations by varying the first and second bend 32A, 32B such that the first and second exercise arms 36A, 36B are angled outwards in opposite directions away from the horizontal exercise bar central point 31.

The vertical supporting member 20 can be configured as a vertically oriented bar, and comprises a vertical supporting member upper end 21 and a vertical supporting member lower end 22. The vertical supporting member 20 serves as the primary load bearing component of the portable exercise device 10 and can be configured as a tube made of steel, aluminum, titanium, or other suitable material which is lightweight and strong as will be apparent to a person of ordinary skill in the art in the field of the invention. The vertical supporting member 20 further has an outer surface 24 corresponding to the exterior of the vertical supporting member 20. The horizontal exercise bar 30 is connected to the vertical supporting member upper end 21, while the anchoring assembly 80 is connected to the vertical supporting member lower end 22. The vertical supporting member 20 may be configured in other cross-sectional shapes. For example, the vertical supporting member 20 may be configured as a rectangular tube, and it will be apparent to a person of ordinary skill in the art in the field of the invention to modify the elements of the portable exercise device 10 accordingly, in adherence to the principles of the present disclosure.

Figure 2:
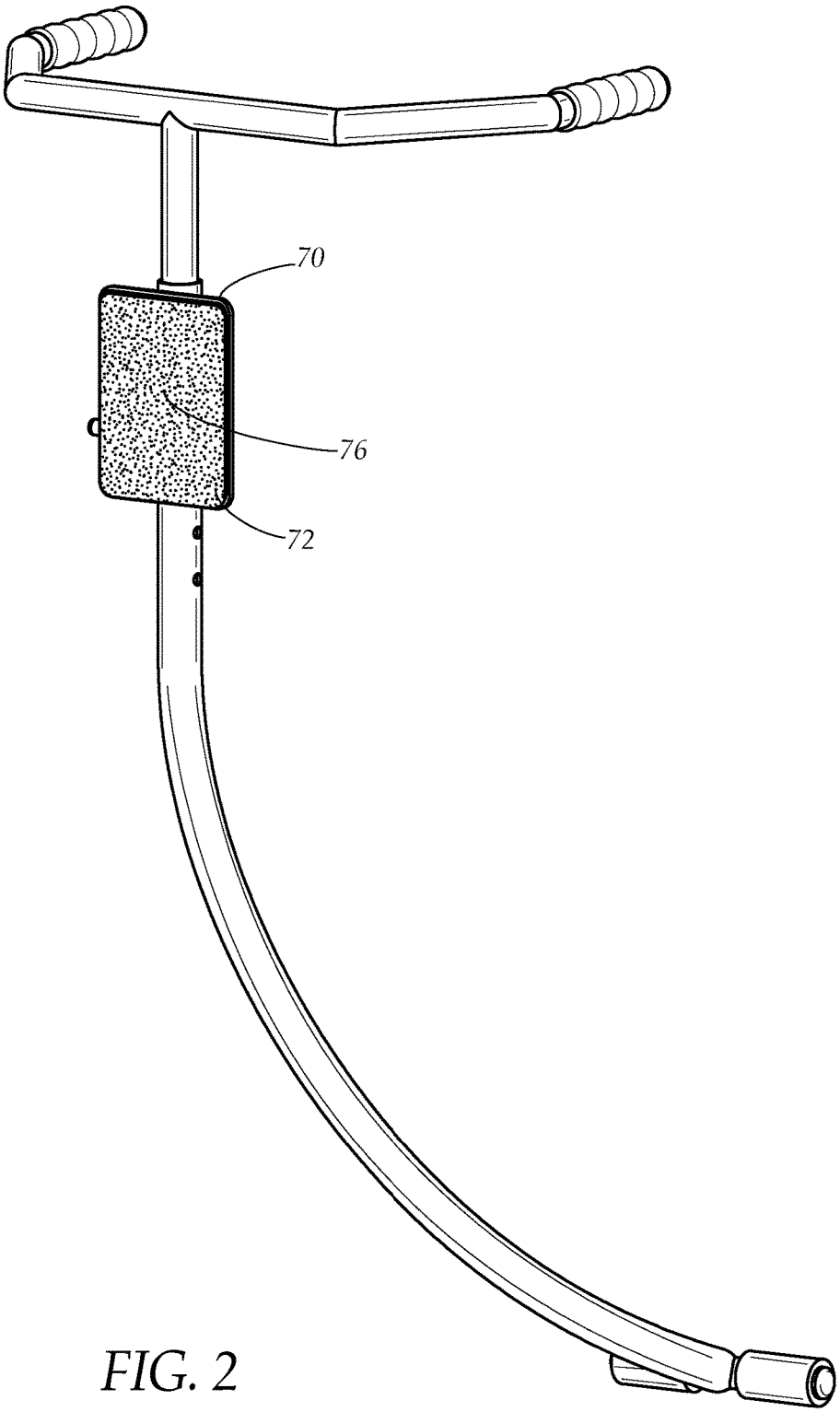
FIG. 2 is a diagrammatic perspective view showing an exemplary vertical support plate configured with a friction layer, in accordance with the present disclosure.
Figure 3A:
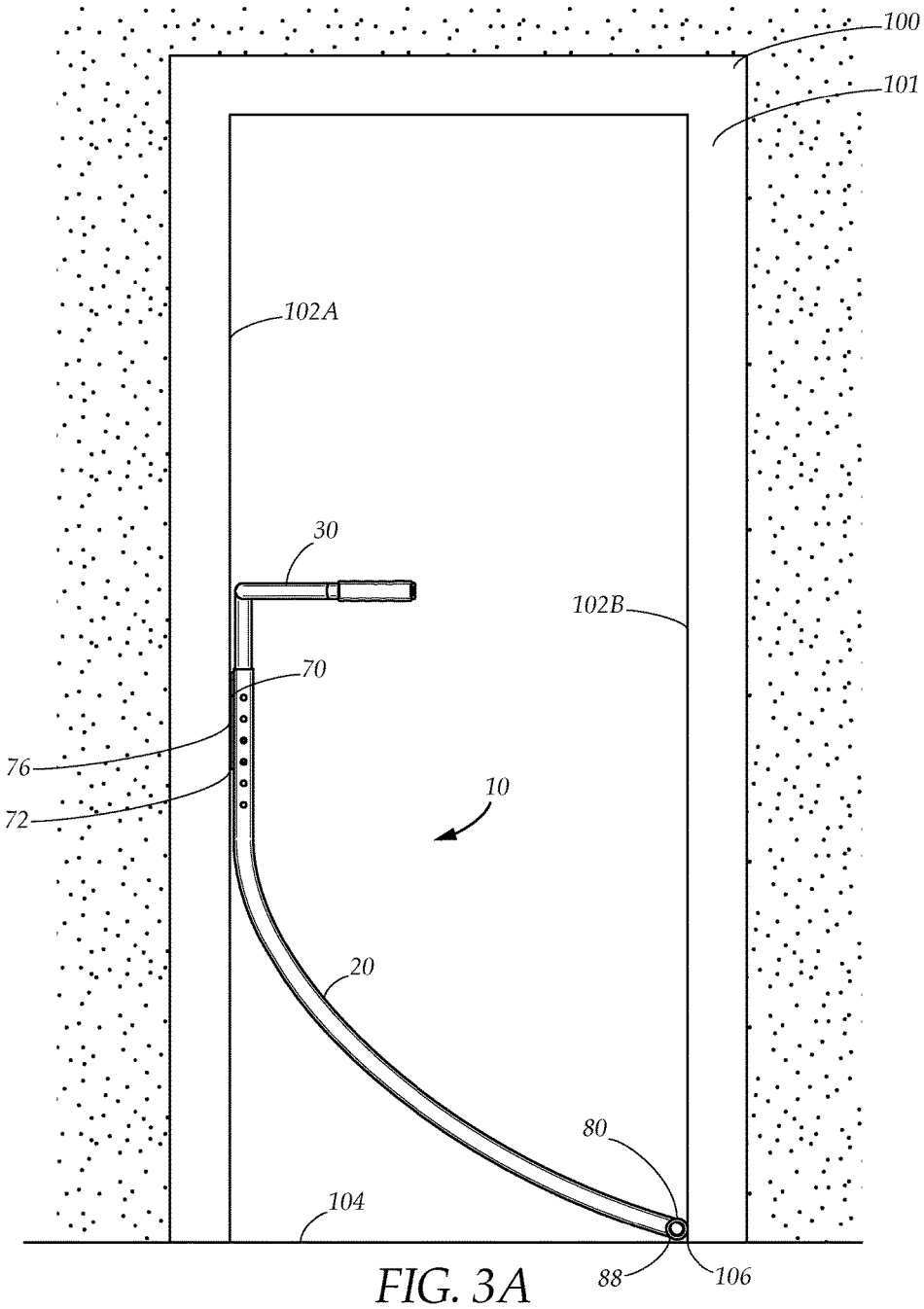
FIG. 3A is a diagrammatic side view of the portable exercise device positioned inside a doorway, in accordance with the present disclosure.

Referring to FIGS. 1 and 2 simultaneously, the vertical support plate 70 is substantially flat, and comprises a vertical support plate outer face 72 and a vertical support plate inner face 74. The vertical support plate inner face 74 is attached to the vertical supporting member outer surface 24 near the vertical supporting member upper end 21. Referring to FIGS. 1, 2, and 3A simultaneously, the vertical support plate 70 is configured so that the vertical support plate outer face 72 abuts against the first vertical side 102A of the doorway 100. The vertical support plate 70 may further comprise a friction layer 76 disposed on the vertical support plate outer face 72. The friction layer 76 is composed of a material with high frictional properties which prevents the vertical support plate outer face 72 from shifting position as it abuts against the first vertical side 102A. The friction layer 76 may be configured as a pad of polyurethane gel, foam, rubber, or other material with high frictional properties, as will be apparent to a person of ordinary skill in the art in the field of the invention. A friction layer 76 made of gel, foam, or other similar material has the additional benefit of being compressible, creating a cushioned contact between the vertical support plate and the first vertical side 102A, preventing the vertical support plate outer face 72 from scratching or damaging the first vertical side 102A.

Referring simultaneously to FIGS. 1 and 3A, the anchoring assembly 80 is connected to the vertical supporting member lower end 22. The anchoring assembly 80 comprises a horizontally oriented anchoring bar 82 having an anchoring bar first end 84A, an anchoring bar second end 84B, and an anchoring bar central point 86 located between the anchoring bar first and second ends 84A, 84B. The anchoring bar 82 can be configured as a tube or bar with a circular, rectangular, or other cross-sectional shape which is formed from steel, aluminum, titanium, or other suitable material. The vertical supporting member lower end 22 may be attached to the anchoring bar central point 86. The anchoring assembly 80 is configured to anchor the portable exercise device 10 at an anchoring point 106. The junction between the vertical plane defined by the second vertical side 102B and the horizontal plane defined by the threshold 104 forms the anchoring point 106, and the anchoring bar 82 is configured to engage with the anchoring point 106 by simultaneously contacting both the second vertical side 102B and the threshold 104. The anchoring assembly 80 may further have a pair of friction sleeves 88 which further comprise a first friction sleeve 88A configured at the anchoring bar first end 84A and a second friction sleeve 88B configured at the anchoring bar second end 84B. The first and second friction sleeves 88A, 88B may be configured as sleeves with a cross-sectional shape matching that of the anchoring bar 82 which wrap around the anchoring bar first and second ends 84A, 84B respectively, or may be implemented as pads or strips positioned along the anchoring bar 82. The friction sleeves 88 may be formed from polyurethane gel, foam, rubber, or other similar material with high frictional properties, as will be apparent to a person of ordinary skill in the art in the field of the invention. The friction sleeves 88 allow the anchoring assembly 80 to more securely engage with the anchoring point 106 by increasing the friction at the point of contact between the anchoring bar 82, the second vertical side 102B, and the threshold 104.

Figure 3B:
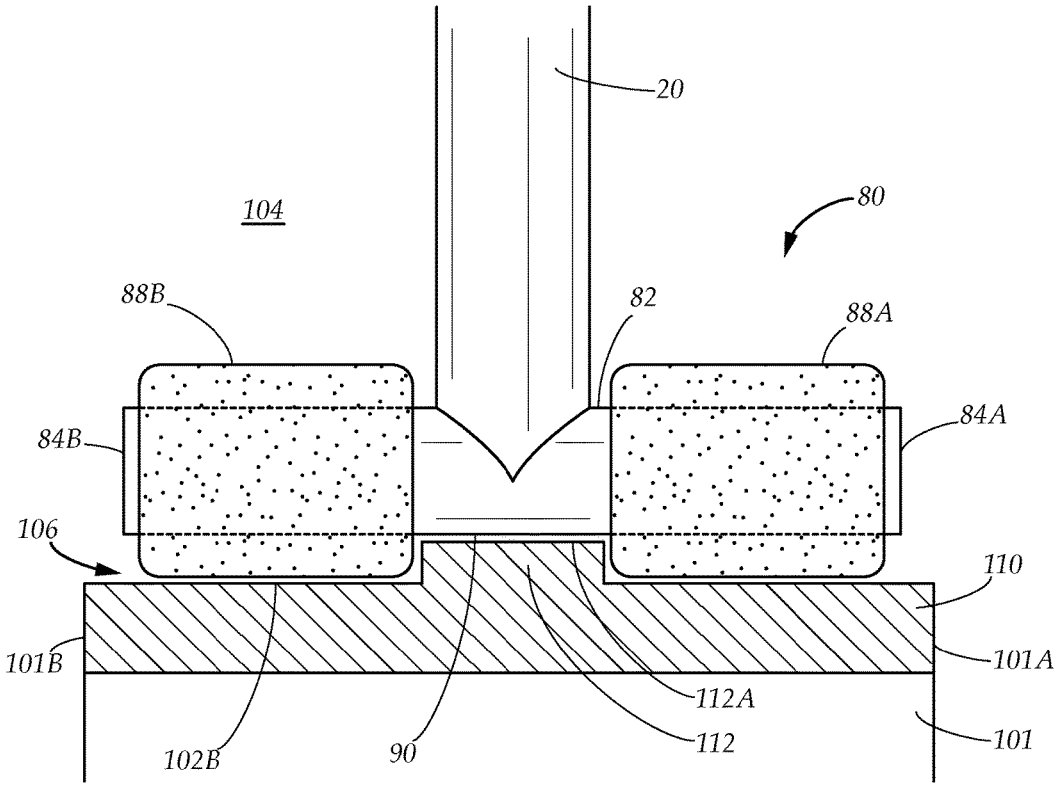
FIG. 3B is a diagrammatic top view of an exemplary anchoring assembly positioned against a door jamb with a door stop, in accordance with the present disclosure.

Referring simultaneously to FIGS. 3A-B, the doorway 100 may incorporate a door frame 101 having a door jamb 110, with the surface of the door jamb 110 corresponding to the second vertical side 102B. The door jamb 110 may have a door stop 112 which protrudes from the door jamb 110 and which runs vertically along the length of the door jamb 110 to the threshold 104. The anchoring assembly 80 can be adapted to engage with the anchoring point 106 around the door stop 112 through the use of friction sleeves 88 having a thickness at least equal to an extrusion distance corresponding to the distance from the second vertical side 102B to the door stop surface 112A. The anchoring assembly 80 may further have a retaining gap 90 defined by the space between the friction sleeve 88A, the anchoring bar 80, and the second friction sleeve 88B, so that the door stop 112 fits within the retaining gap 90, allowing for the transfer of force from the vertical supporting member 20 to the second vertical side 102B and the threshold 104 via the friction sleeves 88, while the first and second friction sleeves 88A, 88B engage the door stop 112 from both sides of the door stop 112 to prevent the anchoring assembly 80 from shifting laterally within the anchoring point 106.

Returning to FIG. 1 while referring simultaneously to FIG. 3A, in a preferred embodiment, the portable exercise device 10 is placed laterally within the doorway 100 such that the vertical support plate outer face 72 contacts the first vertical side 102A, and the anchoring assembly 80 engages with the anchoring point 106. The portable exercise device 10 may have a width, measured along a line running horizontally from the vertical plane defined by the vertical support plate 70 to the anchoring assembly 80, which is substantially the same as the width of the doorway 100 measured as the distance between the first vertical side 102A and the second vertical side 102B. The portable exercise device 10 can be configured to match the width of various interior and exterior doors. For example, the portable exercise device 10 may be configured with widths of thirty or thirty-six inches, corresponding to two commonly used standard door widths. The portable exercise device 10 may have a height, measured as a vertical line running from the threshold 104 to the vertical supporting member upper end 21, of between two to four feet. The height of the portable exercise device 10 can be further varied to account for users and doors of varying height, to enable the user to grasp the first and second hand grips 38A, 38B and perform the upper and lower body exercises without the user's head striking the doorway. When the portable exercise device 10 is in use, the force exerted upon the portable exercise device by the user's weight is transferred from the horizontal exercise bar 30, through the vertical supporting member 20, to the first vertical side 102A via the vertical support plate 70, and to the second vertical side 102B and the threshold 104 via the anchoring assembly 80. By exerting force in opposing directions, the portable exercise device 10 is securely retained between the first vertical side 102A and second vertical side 102B. Unwanted lateral movement of the portable exercise device 10 is further restricted by the high frictional properties of the friction layer 76 and the friction sleeves 88. When the portable exercise device 10 is not in use, it can be removed from within the doorway 100 by detaching the vertical support plate 70 from the first vertical side 102A and disengaging the anchoring assembly 80 from the anchoring point 106.

Referring to FIG. 3B, the anchoring bar 82 may be configured in a variety of widths. In one embodiment, the width of the anchoring bar 82 as measured from the anchoring bar first end 84A to the anchoring bar second end 84B, may approximately match the thickness of the door frame 101 measured as the distance between door frame first surface 101A and the door frame second surface 101B. For example, this distance may be approximately 5 to 6.5 inches, corresponding to a range of common thicknesses of interior walls within buildings. By configuring the width of the anchoring bar 82 to match the thickness of the door frame 101, the contact between the anchoring assembly 80 and the second vertical side 102B is maximized. The width of the anchoring bar 82 may be increased or decreased as required, as the anchoring bar 82 need not be configured to match the specific thickness of any wall in order to effectively engage with a variety of common door frames and walls of various thicknesses.

Returning to FIG. 1 while also referring to FIG. 3A, the vertical supporting member 20 may further comprise a vertical supporting member bend 28 disposed in between the vertical supporting member upper end 21 and the vertical supporting member lower end 22, such that the vertical supporting member 20 is bent at an angle at the vertical supporting member bend 28 and extends away from the first vertical side 102A towards the anchoring point 106. In one embodiment, the vertical supporting member bend 28 is disposed on the vertical supporting member 20 at a distance from the vertical supporting member upper end 21 approximately equal to one-third of the length of the vertical supporting member 20 measured from the vertical supporting upper end 21 to the vertical supporting member lower end 22. The vertical supporting member bend 28 may also be disposed just below the vertical extension sleeve 41.

In a preferred embodiment, the vertical supporting member 20 may further comprise a vertical supporting member arc 26, where the vertical supporting member 20 curves away from the first vertical side 102A and towards the second vertical side 102B, forming the vertical supporting member arc 26 which extends from the vertical supporting member bend 28 to the vertical supporting member lower end 22.

Figure 4:
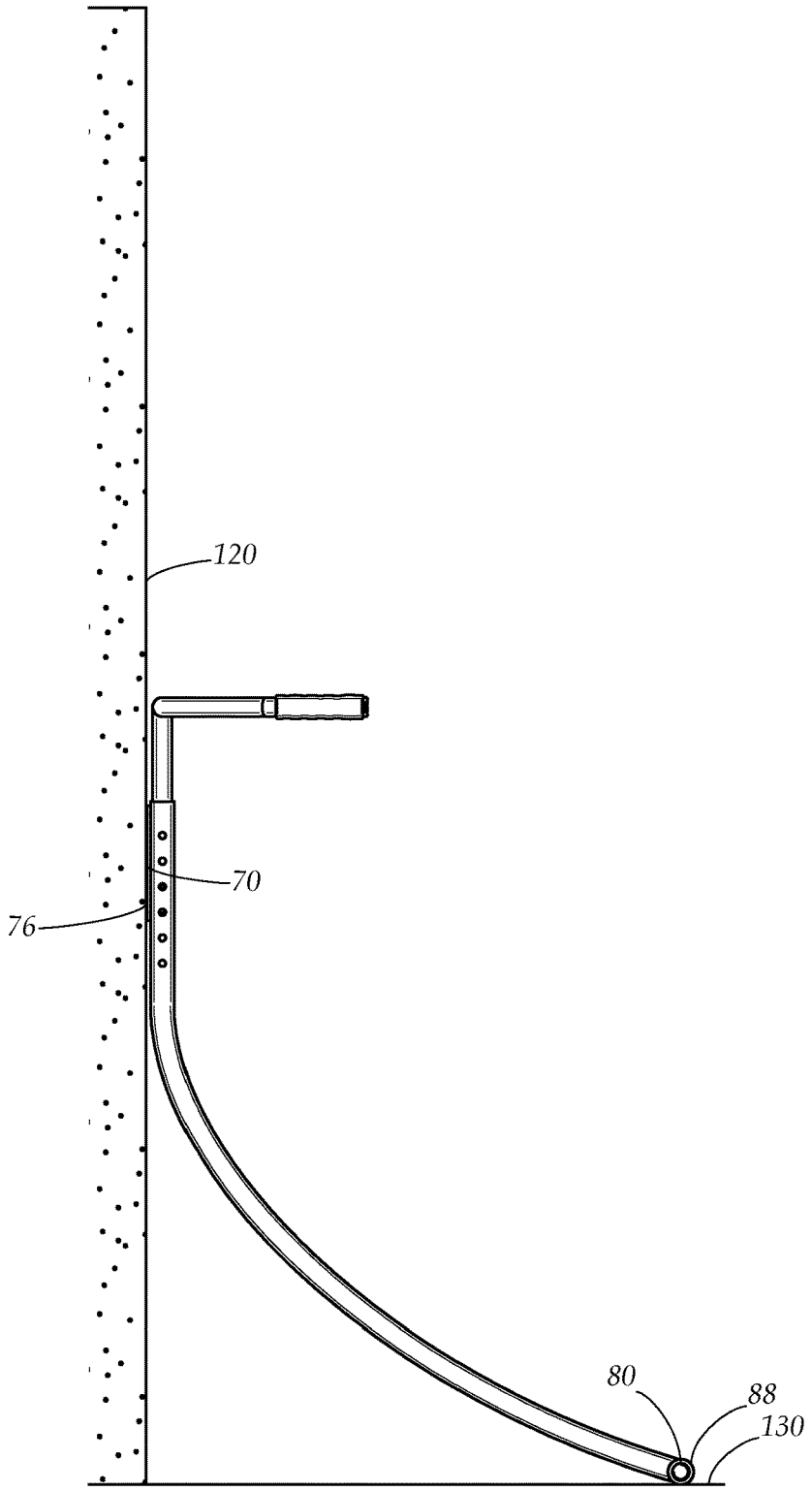
FIG. 4 is a diagrammatic side view of the portable exercise device positioned against a vertical supporting surface, in accordance with the present disclosure.

Turning now to FIG. 1 and FIG. 4, the portable exercise device 10 may also be used in an alternate configuration where the vertical support plate 70 is positioned against a vertical supporting surface 120, such as a wall or other vertical planar surface, and the anchoring assembly 80 is positioned against a horizontal supporting surface 130, such as a floor or other horizontal planar surface. The width of the anchoring bar 82 may be increased to approximately match the distance between the first exercise arm 36A and the second exercise arm 36B to increase the stability of the portable exercise device 10 by preventing unwanted lateral movement.

Figure 5A:
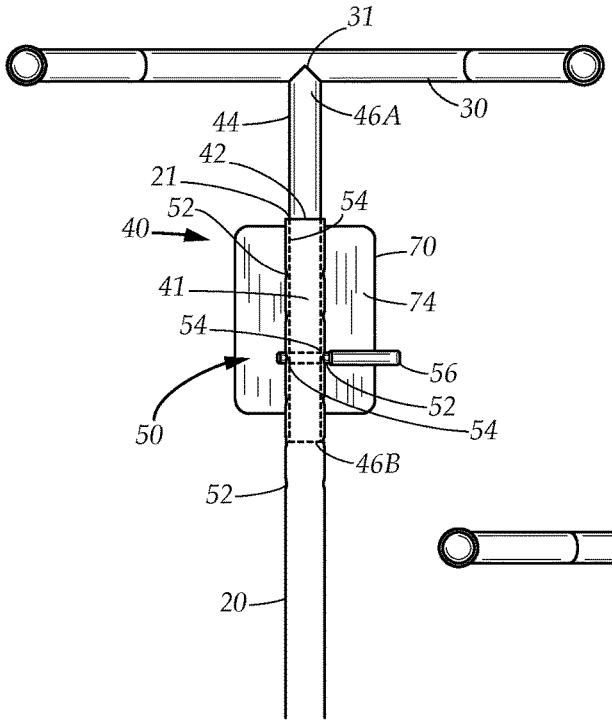
FIG. 5A is a diagrammatic front view of the portable exercise device, showing an exemplary vertical extension assembly which forms an extensible connection between the horizontal exercise bar and the vertical supporting member, in accordance with the present disclosure.
Figure 5B:
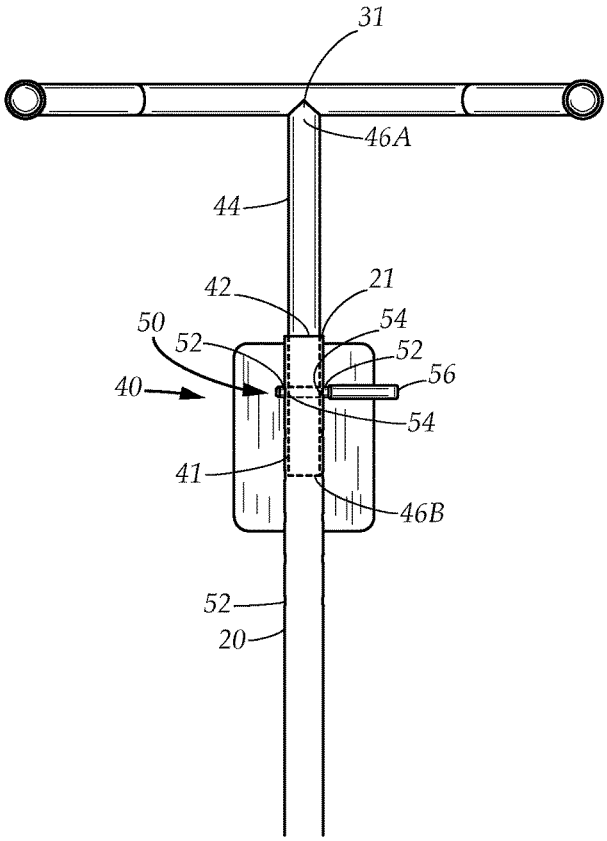
FIG. 5B is a diagrammatic front view of the portable exercise device, showing the exemplary vertical extension assembly in an extended position where the horizontal exercise bar is raised vertically in relation to the vertical supporting member.

Referring simultaneously to FIGS. 1 and 5A-B, the vertical extension assembly 40 can be configured to form an extensible connection linking the horizontal exercise bar 30 to the vertical supporting member 20. The vertical extension assembly comprises a vertical extension sleeve 41 and a vertical extension member 44. The vertical extension sleeve 41 has a vertical extension sleeve opening 42 adapted to receive and retain the vertical extension member 44. The vertical extension member 44 has a vertical extension member upper end 46A connected to the horizontal exercise bar 30 and a vertical extension member lower end 46B extending in a downward direction such that the vertical extension member lower end 46B is retained within the vertical extension sleeve opening 42. The vertical extension assembly 40 is further configured so that the vertical extension member 44 can extend and retract axially within the vertical extension sleeve 41. In an embodiment, the vertical supporting member 20 is configured as a hollow tube, allowing the vertical extension member upper end 21 to serve as the vertical extension sleeve 41, and the vertical extension member 44 is formed as a tube or bar with a cross-sectional shape matching that of the vertical supporting member 20. The vertical extension member 44 may be formed out of steel, aluminum, titanium, or other suitable material. In an alternate embodiment, the portable exercise device 10 can be configured without the vertical extension assembly 40, and the horizontal exercise bar 30 may be connected directly to the vertical supporting member upper end 21 at the horizontal exercise bar central point 31.

FIG. 5A depicts the vertical extension assembly 40 in a position where the vertical extension member 44 is in a retracted position where the greater portion of the vertical extension member 44 is retained within the vertical extension sleeve opening 42. FIG. 5B depicts the vertical extension assembly 40 in an extended position where the greater portion of the vertical extension member 44 is outside of the vertical extension sleeve opening 42 while the vertical extension member lower end 46B remains retained within the vertical extension sleeve opening 42.

Figure 6:
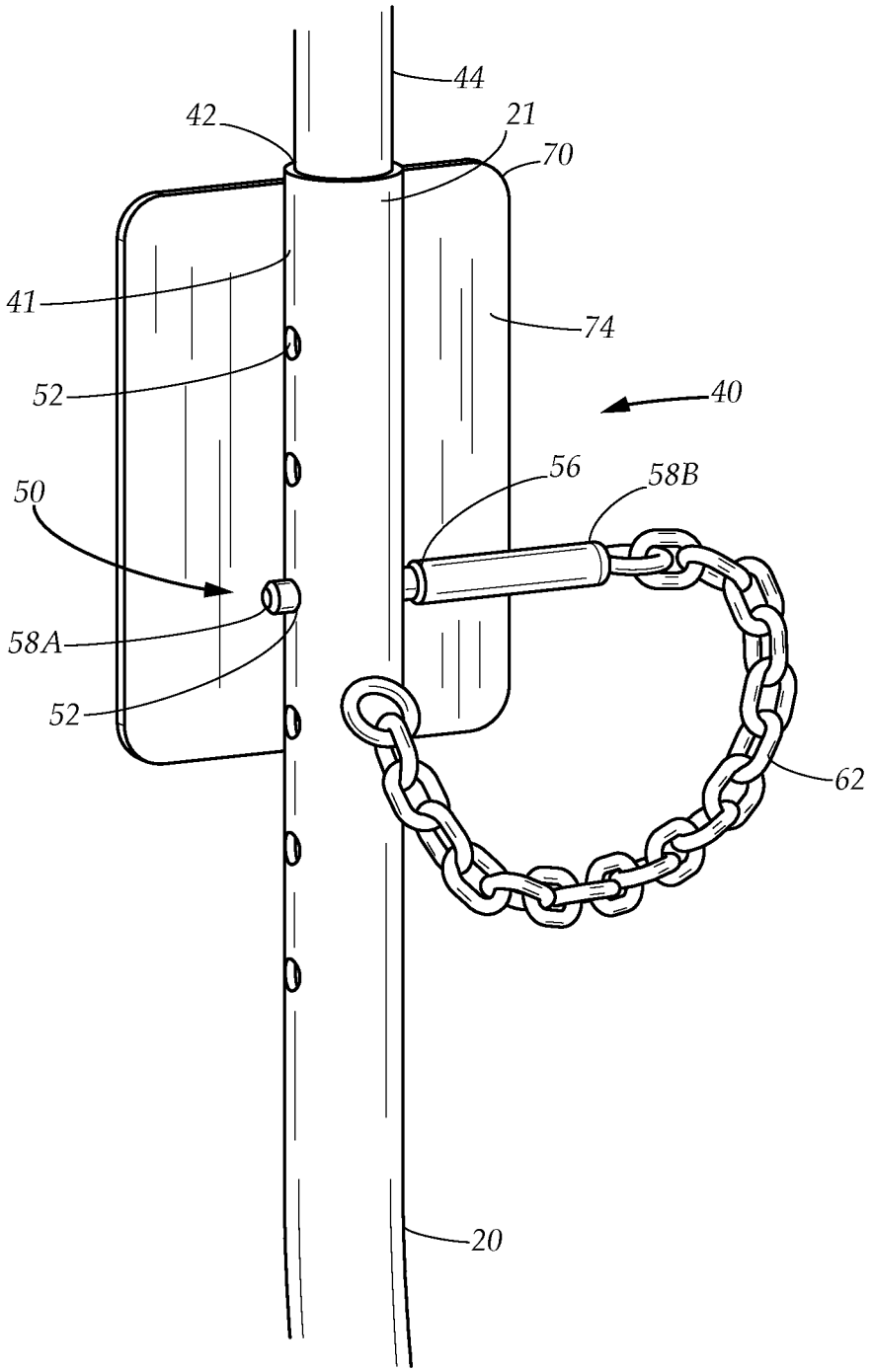
FIG. 6 is a diagrammatic perspective view depicting an exemplary vertical extension locking mechanism configured to lock the vertical extension assembly in an extended or retracted position.

Referring to FIGS. 5A-B and 6 simultaneously, the vertical extension assembly 40 may further comprise a vertical extension locking mechanism 50 configured to lock the position of the vertical extension member 44 relative to the vertical extension sleeve opening 42. In a preferred embodiment, the vertical extension locking mechanism 50 comprises a set of vertical extension sleeve adjustment holes 52 and vertical extension member adjustment holes 54 disposed as diametrically opposed pairs on opposite sides of the vertical extension sleeve 41 and the vertical extension member 44 respectively. The vertical extension locking mechanism 50 further comprises an adjustment locking bar 56. When the vertical extension member 44 is positioned within the vertical extension sleeve opening 42, the set of vertical extension sleeve adjustment holes 52 and vertical extension member adjustment holes 54 are aligned along a line passing diametrically through the center axis of both the vertical extension sleeve 41 and the vertical extension member 44, allowing the adjustment locking bar 56 to pass through the vertical extension sleeve adjustment holes 52 and vertical extension member adjustment holes 54 to lock the vertical extension assembly 40 in place by preventing further movement of the vertical extension member 44 within the vertical extension sleeve opening 42. Additional sets of vertical extension sleeve adjustment holes 52 and vertical extension member adjustment holes 54 can be positioned along the vertical extension sleeve 41 and vertical extension member 44 at regular intervals, allowing the adjustment locking bar 56 to lock the position of the vertical extension member 44 in different positions as it extends or retracts within the vertical extension sleeve opening 42, such as in a fully retracted position, a fully extended position, or one or more incremental extension positions in between the fully retracted and fully extended positions. To adjust the position of the vertical extension member 44, the adjustment locking bar 56 is removed, allowing the vertical extension member 44 to move axially within the vertical extension sleeve opening 42 to a new position where at least one pair of vertical extension sleeve adjustment holes 52 are in alignment with one pair of vertical extension member adjustment holes 54. The adjustment locking bar 56 is then re-inserted, which locks the vertical extension member 44 in the new position.

The vertical extension member adjustment holes 54 can be placed on the vertical extension member 44 at any point between the vertical extension member upper end 46A and the vertical extension member lower end 46B. The vertical extension sleeve adjustment holes 52 can be placed anywhere along the vertical extension sleeve 41. In one embodiment, the vertical extension locking mechanism 50 has six sets of vertical extension sleeve adjustment holes 52 and vertical extension member adjustment holes 54 with an interval of two inches in between each set, allowing for the vertical extension assembly 40 to be locked in four incremental extension positions in addition to the fully extended and fully retracted positions. Other variations are possible, and the number of sets of vertical extension sleeve adjustment holes 52 and vertical extension member adjustment holes 54, along with the length of the intervals, can be increased or decreased.

The horizontal exercise bar 30 can be configured so that it can be detached from the vertical supporting member 20, by first removing the adjustment locking bar 56, and lifting the horizontal exercise bar 30 until the vertical extension member 44 is no longer retained within the vertical extension sleeve opening 42.

Turning now to FIG. 6 while continuing to refer to FIGS. 5A-B, the adjustment locking bar 56 comprises an adjustment locking bar first end 58A with a diameter smaller than the diameter of the vertical extension sleeve adjustment holes 52 and vertical extension member adjustment holes 54. The adjustment locking bar 56 may further comprise an adjustment locking bar second end 58B, which may have a diameter larger than the diameter of the vertical extension sleeve and vertical extension member adjustment holes 52, 54. The adjustment locking bar second end 58B prevents the adjustment locking bar 56 from being inserted too far and passing completely through the vertical extension assembly 40. The adjustment locking bar second end 58B may further be attached to the vertical supporting member 20 via a chain 62, lanyard, string, or other similar apparatus, to keep the adjustment locking bar 56 within the reach of the user while also preventing the adjustment locking bar 56 from being misplaced.

Figure 7:
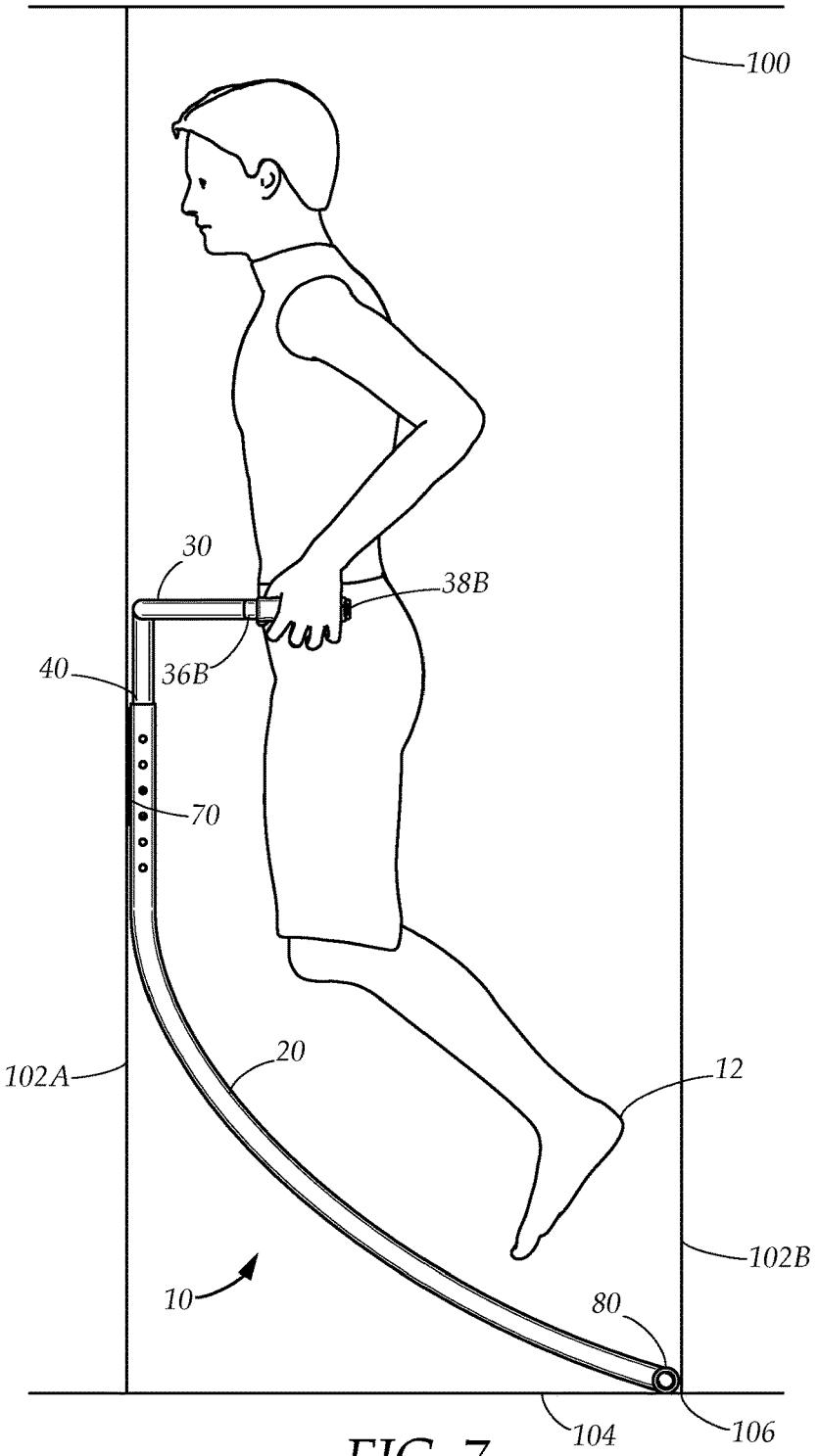
FIG. 7 is a diagrammatic side view depicting a user performing an upper body exercise using the portable exercise device.

Turning now to FIG. 7 while referring simultaneously to FIG. 1, the user 12 may perform upper body exercises such as dips using the portable exercise device 10. The user 12 first stands between the first and second exercise arms 36A, 36B while grasping the first and second handgrips 38A, 38B with both hands. The user 12 may face the first vertical side 102A, providing space between the user 12 and the second vertical side 102B so that the user's legs may be bent at the knees. Next, the user 12 pushes against the first and second handgrips 38A, 38B so that the user's arms are straight and the user 12 is suspended between the first and second exercise arms 36A, 36B. The user 12 may then perform dips by repeatedly bending and then straightening his or her arms while remaining suspended between the first and second exercise arms 36A, 36B. In order to vary the amount of clearance between the user's legs and the threshold 104, the horizontal exercise bar 30 may be extended or retracted via the vertical extension assembly 40. The horizontal exercise bar 30 may also be retracted to prevent the user's head from striking the doorway 100.

Figure 8:
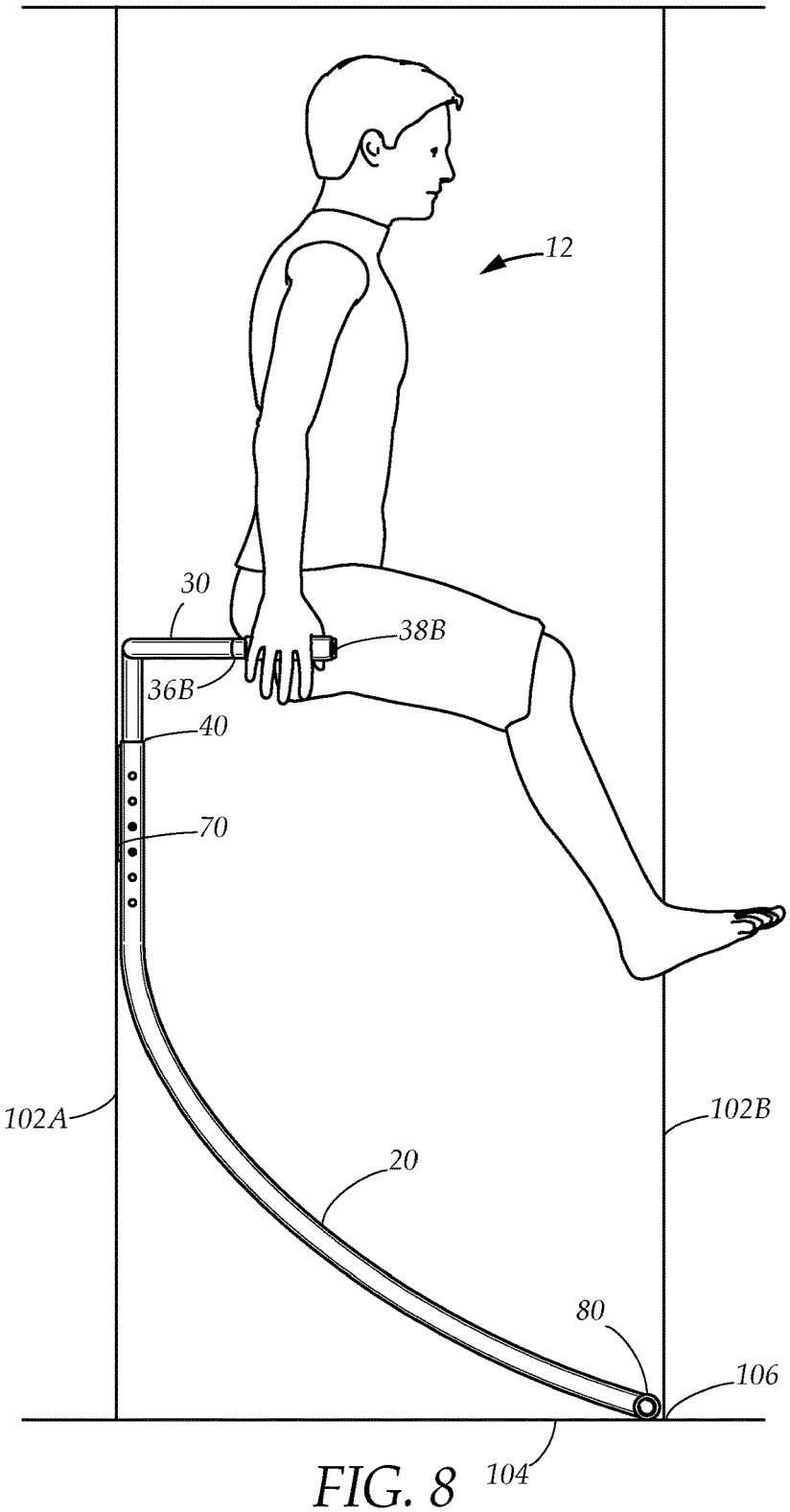
FIG. 8 is a diagrammatic side view depicting the user performing a lower body exercise using the portable exercise device.

Referring now to FIG. 8 while simultaneously referring to FIG. 1, the user 12 may perform lower body exercises, such as leg lifts, using the portable exercise device 10. First, the user 12 stands between the first and second exercise arms 36A, 36B while facing towards the second vertical side 102B. Next, the user 12 grasps the first and second handgrips 38A, 38B and then pushes against the first and second handgrips 38A, 38B so that the user's arms are straight and the user 12 is suspended between the first and second exercise arms 36A, 36B. The user 12 may then perform leg lifts by repeatedly raising and lowering his or her legs while remaining suspended between the first and second exercise arms 36A, 36B. Note that the examples of dip and leg lift exercises are non-limiting, and it will be apparent to a person of ordinary skill in the art in the field of the invention that other types of exercises may be performed using the portable exercise device.

It is understood that when an element is referred hereinabove as being "on" another element, it can be directly on the other element or intervening elements may be present therebetween there between. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented a portable exercise device. The disclosure is illustrated by example in the drawing figures, and throughout the written description. It should be understood that numerous variations are possible, while adhering to the inventive concept. Such variations are contemplated as being a part of the present disclosure.

What is claimed is:

1. A method for allowing a user to perform an upper body and a lower body exercise within a doorway having a first vertical side, a second vertical side, and a threshold, the doorway further having an anchoring point defined by the junction of the second vertical side and the threshold of the doorway, the method comprising the steps of:

providing a portable exercise device comprising a horizontal exercise bar, a vertical supporting member, and an anchoring assembly, wherein the horizontal exercise bar comprises a first exercise arm, a second exercise arm, and a horizontal exercise bar central point, the first and second exercise arms having a first hand grip and a second hand grip respectively, wherein the first exercise arm and the second exercise arm are arranged in a parallel configuration, wherein the vertical supporting member comprises a vertical supporting member upper end attached to the horizontal exercise bar central point and a vertical supporting member lower end attached to the anchoring assembly, wherein the vertical supporting member further has a vertical support plate attached near the vertical supporting member upper end;

positioning the portable exercise device across the doorway such that the vertical support plate abuts against the first vertical side of the doorway and the anchoring assembly engages with the anchoring point by simultaneously contacting the second vertical side and the threshold of the doorway, causing the portable exercise device to be retained in position between the first and second vertical sides of the doorway;

the user performing the upper body exercise by (a) standing between the first and second exercise arms while facing the first vertical side of the doorway and grasping the first and second hand grips, (b) pushing against the first and second hand grips while straightening the arms so the user's body is suspended between the first and second exercise arms, and (c) repeatedly bending and straightening the arms to perform a series of dips; and the user performing the lower body exercise by (a) standing between the first and second exercise arms while facing the second vertical side of the doorway and grasping the first and second hand grips, (b) pushing against the first and second hand grips while straightening the arms so the user's body is suspended between the first and second exercise arms, and (c) repeatedly raising and lowering the legs to perform a series of leg lifts.

2. The method of claim 1, wherein the portable exercise device further comprises a vertical extension assembly forming an extensible connection between the horizontal exercise bar and the vertical supporting member, the vertical extension assembly comprising a vertical extension member and a vertical extension sleeve, wherein the vertical extension sleeve is attached to the vertical supporting member and is configured to receive and retain the vertical extension member, allowing the horizontal exercise bar to be vertically raised and lowered.

3. The method of claim 2, wherein the vertical supporting member further comprises a vertical supporting member bend disposed below the vertical extension sleeve, and the vertical supporting member bends at the vertical member supporting bend in a direction away from the first vertical side of the doorway and extends towards the anchoring point.

4. The method of claim 3, wherein the vertical supporting member curves away from the vertical supporting member bend towards the anchoring point, forming a vertical supporting member arc which extends from the vertical supporting member bend to the anchoring assembly.

5. The method of claim 4, wherein the vertical support plate further comprises an outer face disposed towards the first vertical side of the doorway and a friction layer disposed on the outer face of the vertical support plate configured to abut against the first vertical side of the doorway, wherein the friction layer is composed of high-friction material which allows the vertical support plate to grip the first vertical side of the doorway.

6. The method of claim 5, wherein the anchoring assembly further comprises an anchoring bar, the anchoring bar having an anchoring bar first end, an anchoring bar second end, and an anchoring bar central point attached to the vertical supporting member lower end, wherein the step of positioning the portable exercise device across the doorway comprises the anchoring assembly engaging with the anchoring point by simultaneously contacting the second vertical side and the threshold of the doorway.

7. The method of claim 6, wherein the anchoring bar first end is configured with a first friction sleeve and the anchoring bar second end is configured with a second friction sleeve, wherein the first and second friction sleeves are composed of high-friction material which allow the anchoring assembly to grip the anchoring point.

* * * * *